United States Patent [19]

Nishikawa

[11] Patent Number: 4,550,998

[45] Date of Patent: Nov. 5, 1985

[54] TONER CONCENTRATION DETECTING DEVICE

[75] Inventor: Masaji Nishikawa, Hachioji, Japan

[73] Assignee: Olympus Optical Company Limited, Tokyo, Japan

[21] Appl. No.: 369,084

[22] Filed: Apr. 16, 1982

[30] Foreign Application Priority Data

Apr. 16, 1981 [JP] Japan ..... 56-57633

[51] Int. Cl.[4] ..... G03G 15/08

[52] U.S. Cl. ..... 355/3 DD; 118/691; 355/14 D

[58] Field of Search ..... 355/3 R, 3 DD, 14 D; 118/689, 690, 691

[56] References Cited

U.S. PATENT DOCUMENTS 3,765,654 10/1973 Rarey et al. ..... 118/691 X
4,346,985 8/1982 Watson et al. ..... 355/14 D
4,347,299 8/1982 Ozawa et al. ..... 355/14 D X
4,369,733 1/1983 Hirakura et al. ..... 118/691
4,431,300 2/1984 Snelling ..... 355/14 D

*Primary Examiner*—Fred L. Braun
*Attorney, Agent, or Firm*—Fleit, Jacobson, Cohn & Price

[57] ABSTRACT

A magnetic brush developing apparatus including a magnet roll assembly to apply a dry-type, two-component, magnetic developer having magnetic carrier particles and toner particles to an electrostatic latent image to be developed. The toner concentration of the developer is detected by projecting light toward ear-ups of the developer through a transparent plate which is arranged at such a position that the ear-ups of the developer held and carried by the magnetic roll assembly are brought in contact with the plate and by receiving light scattered by the developer through the transparent plate. The transparent plate is formed as a transparent plate to which is applied a bias voltage of such polarity that the charged toner is repelled by the plate.

18 Claims, 17 Drawing Figures

TONER CONCENTRATION DETECTING DEVICE

BACKGROUND OF THE INVENTION

1. Field of the Invention

This invention relates to a device for detecting the toner concentration of a dry-type, two-component magnetic developer consisting of magnetic carrier powders and toner powders for developing an electrostatic latent image formed on a charge holding body of an electrophotographic copying machine.

2. Description of the Prior Art

Various toner concentration detecting devices for such dry-type two-component magnetic developers have heretofore been known. Known detecting methods may be classified in accordance with operation and principle as follows.

(1) Method for detecting a change of permeability due to a variation of toner concentration of a developer by using a coil.

(2) Method for detecting photoelectrically an amount of the toner adhered to a part of a charged electrophotographic charge holding body or on an electrode surface.

(3) Method for detecting photoelectrically the optical reflectance of the developer or the change of color thereof.

However, in method (1) an extremely small change of permeability must be detected, so that the detecting circuit should be highly sensitive, and it is impossible to detect the toner concentration stably and precisely, because the signal thus obtained is largely varied not only by the change of charged toner amount, but also by the change of fluidity of the developer, and the change of volume and specific gravity caused by stirring. Method (2) requires a structure for adhering toner to the charge holding body or the detecting electrode portion and a photoelectric detecting means, so that the construction becomes complicated, photoelectric detecting surface is further contaminated to reduce measuring precision, or measuring error is caused due to an influence of change of developing efficiency caused by change of toner electrification because of deterioration of the developer. A known toner concentration detecting device relating to method (3) is disclosed in U.S. Pat. No. 3,233,781 in which a transparent window is provided in a wall of the developing apparatus, through which is measured reflectance of a developer, but if toner adheres to the transparent window portion, it is difficult to remove the adhered toner and a large measuring error results. In addition, a device for carrying out said method (3) is also proposed in Japanese Patent Laid-open No. 130,644/77.

However, the toner concentration detecting device proposed in said Japanese Patent Application requires a pressurized air source, so that the device becomes complicated, while the action of the pressurized air source is sometimes insufficient, or if the toner adheres to a photoelectric detector element, particularly to a photoelectric sensor element due to some reason, the photoelectric detecting output is changed and precise measurement cannot be effected. In practice, it is difficult to remove the contamination of the photoelectric detector element. Further, there is a disadvantage in that air flowing out of the housing of the detecting device disperses the toner to contaminate the inside of the copying machine.

SUMMARY OF THE INVENTION

The object of the present invention is to remove the above-described various disadvantages in the aforementioned method (3) for measuring reflectance of a developer, and to provide a toner concentration detecting device which can measure toner concentration highly precisely and stably for a long period by measuring reflected light with high resolving power.

According to the invention, a device for detecting toner concentration of a dry-type, two-component magnetic developer consisting of magnetic carrier powders and toner powders contained in the housing of a developing apparatus having magnet roll means for forming ear-ups of the developer which are brought in contact with a member to be developed comprises transparent plate-like means arranged to be brought in contact with the ear-ups of the developer held and carried by said magnet roll means;

means for projecting light towards the ear-ups of the developer through the transparent plate-like means; and means for receiving light scattered by the ear-ups of the developer through the transparent plate-like means to produce a photoelectrically converted signal representing the toner concentration of the developer.

BRIEF DESCRIPTION OF THE DRAWINGS

For a better understanding of the invention, reference is made to the accompanying drawings, in which.

DESCRIPTION OF THE PREFERRED EMBODIMENTS

Figure 1:
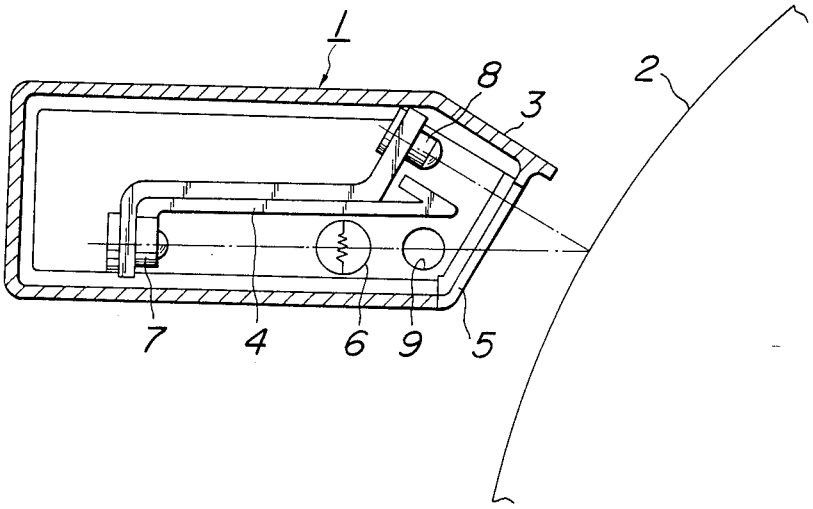
FIG. 1 PRIOR ART
FIG. 1 is a schematic sectional view showing the construction of the essential part of a known toner concentration detecting device.

FIG. 1 shows the construction of the essential part of a known toner concentration detecting device. In this device, a photoelectric detector 1 is arranged adjacent to a position where ear-ups of the developer are formed by a magnet roll assembly 2 comprising magnets and a non-magnetic sleeve. Said photoelectric detector 1 comprises a housing 3, a partition 4 consisting of an opaque member for dividing the housing 3 into two portions and an opening portion 5 facing the magnet roll assembly 2. One portion of the housing 3 divided by the partition 4 is provided with a light source lamp 6 and a photoelectric detector element 7 for stabilizing the light source, and the other portion of the housing 3 is provided with a photoelectric detector element 8 for measuring the reflected light from the developer. In addition, air is supplied from a pressurized air source (not shown) into the housing 3 through an opening 9 formed in the housing 3 so as to prevent the housing from being contaminated by toner. However, this device requires pressurized air source, so that the device becomes complicated, while the action of the pressurized air source is sometimes insufficient, or if the toner adheres to the photoelectric detector element 8, the photoelectric detecting output is changed and thus precise measurement cannot be carried out. In addition, it is difficult to remove the contamination of the photoelectric detector element 8. There is also a disadvantage in that air flowing out of the housing 3 disperses the toner to contaminate the inside of the copying machine.

Figure 2:
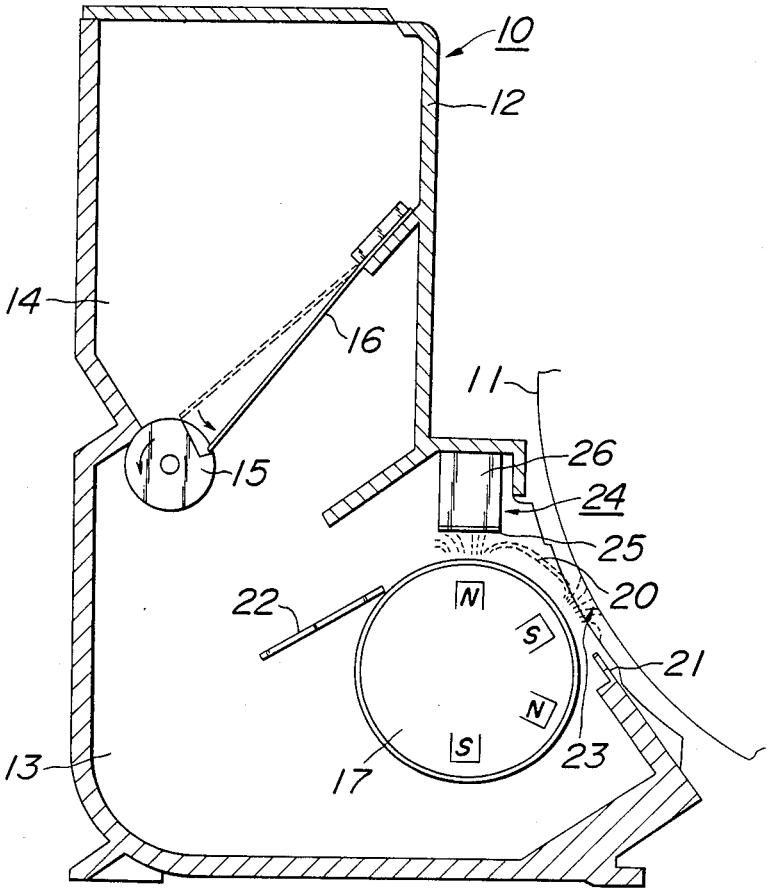
FIG. 2 is a schematic sectional view of an embodiment of a developing apparatus comprising a toner concentration detecting device according to the present invention.

FIG. 2 shows an embodiment of a developing apparatus 10 provided with a toner concentration detecting device according to the invention. This developing apparatus 10 is used for developing an electrostatic latent image formed on a charge holding drum 11. The developing apparatus 10 comprises a housing 12 having a developer containing portion 13 and a toner supply hopper 14. At the lower end portion of the toner hopper 14 there is provided a rotatable grooved toner supply roller 15 the rotation of which is controlled by rotation controlling means (not shown). A vibrating plate 16 serves as a bottom plate of the toner hopper 14 and its free end is engaged with the toner supply roller 15. Said vibrating plate 16 is usually at the dotted-line position, but instantly moves to the solid-line position when the toner supply roller 15 rotates and the groove portion thereof comes to a certain position, so as to discharge the toner remaining in the groove and to vibrate the toner in the hopper 14 to prevent the formation of any toner bridge. A magnet roll assembly 17 is usually composed of a fixed magnet portion and a non-magnetic sleeve arranged rotatably on the outer peripheral portion thereof. In the magnet roll assembly either the magnet or the sleeve rotates, or both the magnet and the sleeve rotate. It should be noted that the invention can be applied to either type of the device. A dry-type, magnetic, two-component developer 20 consisting of magnetic carrier powders and non-magnetic toner powders is held and carried as ear-ups or chains formed by the magnetic force of the magnet roll assembly 17, and the ear-ups act on the charge holding drum 11, thereby developing with the toner an electrostatic latent image formed on the charge holding drum 11. The thickness of the layer of the developer formed on the magnet roll assembly 17 is uniformly regulated by a blade 21, and after the developer 20 has passed through the developing region 23, the developer is released from the magnet roll assembly 17 by another blade 22.

In the present embodiment, at a position spaced from the developing region 23 opposite the charge holding drum 11, there is arranged a detecting unit 24 of a toner concentration detecting device according to the present invention. This detecting unit 24 comprises a transparent plate 25 which is in contact with the ear-ups of the developer 20 formed by the magnet roll assembly 17, and a reflection-type photosensor 26 for measuring reflectance of the developer 20 through said transparent plate 25. If the photosensor 26 is arranged in the housing 12 as shown in FIG. 2, it is preferable to mount said photosensor 26 in air-tight relationship with the transparent plate 25 by means of bonding, or the like, so as to prevent toner from entering into the unit 24 through a space between the photosensor 26 and the transparent plate 25.

Figure 3:
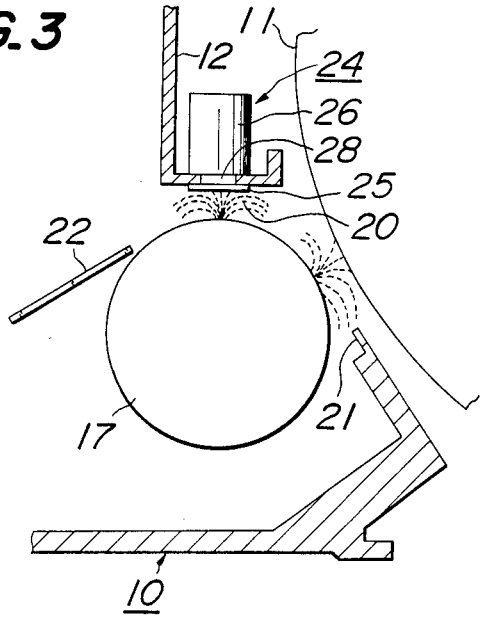
FIG. 3 is a schematic sectional view of another embodiment of the toner concentration detecting device according to the present invention.

FIG. 3 shows an another embodiment of the a toner concentration detecting device according to the present invention in which the photosensor 26 is arranged outside the housing 12 of the developing apparatus 10. In this case, an opening 28 is formed in the housing 12 and the transparent plate 25 is arranged on the lower end surface of the opening 28 so as to be brought into contact with the ear-ups of the developer 20. In this manner, as the photosensor 26 is outside the housing 12, toner does not adhere to the photosensor 26 directly, and therefore it is not necessary to hermetically seal the transparent plate 25 with the photosensor 26. In addition, the transparent plate 25 may also be fixed into the opening 28.

Figure 4:
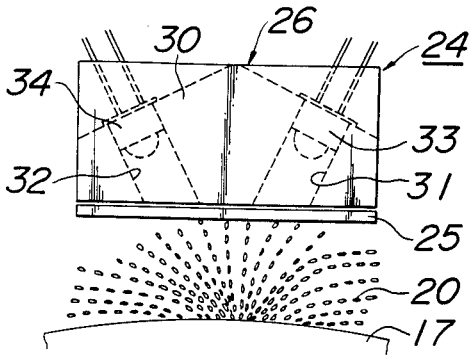
FIG. 4 is a schematic diagram showing the detailed construction of the detecting end portion of the toner concentration detecting device shown in FIG. 2.

FIG. 4 shows the detecting unit 24 of the toner concentration detecting device shown in FIG. 2, in which the photosensor 26 is constructed in such a manner that openings 31 and 32 are formed in support block 30, a light source 33 being arranged in one opening 31 and a photoelectric transducer element 34 being arranged in the other openings 32. As the light source 33, use preferably may be made of GaAs infrared radiation emitting diode which generates little heat and in which temperature variation causes only small luminous intensity changes. In addition, as the photoelectric transducer element 34, use may be made of an element such as a Si phototransistor which can produce a large signal in response to a low light level. As an assembly of the light source and the photoelectric transducer element which are united with each other in the above manner, it is possible to use a reflection-type photosensor ON2152 sold by Matsushita Denki Sangyo, for example. In addition, as the transparent plate 25, use may be made of a glass plate, a mica plate or a transparent plastic plate. It is more important that this transparent plate 25 is arranged so as to be in contact with the ear-ups of the developer 20 rather than simply as a cover for the photosensor 26. By means of such a construction the transparent plate 25 can serve to stabilize the detecting output by aligning the height of the ear-ups of the developer 20 to a certain level. Further, the toner adhered to the transparent plate 25 temporarily can be removed by the cleaning action of the ear-ups of the developer so that the surface of the transparent plate 25 is always maintained in a clean condition free of toner. The ear-up portion of the developer 20 opposite to the transparent plate 25 is aligned along a magnetic line of the magnet roll assembly 17 and its height is defined by the transparent plate 25, as a result of which the developer 20 is dense at the portion spaced from the ear-up forming portion but becomes sparse toward the ear-up portion so as to make gaps. Light from the light source 33 arrives at the developer 20 through the transparent plate 25 and the ear-up gaps and is scattered irregularly by the toner. A part of the scattered light arrives at the photoelectric transducer element 34 through the transparent plate 25.

As described above, the present embodiment is to reliably measure the reflectance of the developer 20 with the aid of the height regulating action of the ear-ups by the transparent plate 25, the cleaning action due to the ear-up portion of the developer 20 with respect to the transparent plate 25 and the phenomenon of producing gaps in the ear-up portion.

According to the embodiment shown in FIG. 4, the reflectance of the developer 20 can sufficiently stably be measured, but error might be produced depending upon measuring conditions. For instance, if the transparent plate 25 is made of material whose position on the triboelectric series is apart from that of the developer 20, electrostatic charge might be produced on the transparent plate 25 due to friction of the plate with the ear-ups of the developer 20. If the electrification polarity owing to the triboelectricity of this transparent plate 25 is opposite to that of electrification of the toner, toner adheres to the transparent plate 25, as a result of which the transparency thereof is lowered and detecting output is also reduced. The electric charge amount by the triboelectricity is greatly changed by the humidity condition of the environment, so that the detecting output is also changed accordingly. In order to prevent such a drawback, the transparent plate 25 to be used in combination with positively charged toner preferably is made from glass, mica, and the like, whose position on the triboelectric series is on the more positive side than is the toner material, while as the material of the plate for the negatively charged developer preferably cellulose nitrate, hard vinyl chloride, and the like, whose position on the triboelectric series is in the more negative side than is the toner material.

In order to positively avoid any influence of the triboelectricity of the transparent plate 25, or in order to avoid any influence of the fog toner which will be described later on, it is advantageous that the transparent plate 25 is composed of a conductive member so as to form a transparent electrode and this transparent electrode 25 is connected to a member having a stable potential so as to maintain the potential of the transparent electrode 25 to a certain potential with respect to the magnet roll assembly 17. The material for such a transparent electrode may be a conductive resin having a low resistance value, such as MB type resin (transparency: 92.1%, volume specific resistance: $3.7\times10^{10}\Omega\cdot$cm) manufactured by Kureha Kagaku Kogyo. In addition to the above, it is also possible to use a transparent plate whose surface adjacent to the developer is made electroconductive, such as nesa glass coated with a thin tin oxide film on the surface of a glass plate, metal coated film such as palladium coated plastic film, or a plate coated with a metal oxide film such as $In_2O_3$, $SnO_2$, and the like.

Figure 5A:
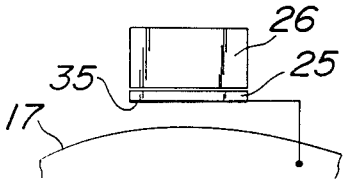
FIGS. 5*a*, 5*b* and 5*c* are schematic diagrams showing three embodiments of an essential part of the toner concentration detecting device according to the present invention.
Figure 5B:
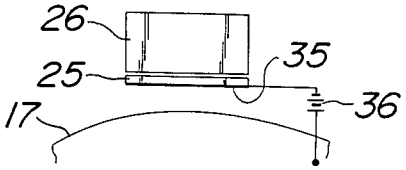
Figure 5C:
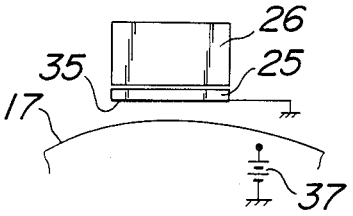

FIGS. 5*a* to 5*c* show three embodiments, in each of which a transparent electrode 35 such as described above is arranged on the side where the developer is in contact and said electrode 35 is maintained to a stable potential. FIG. 5*a* shows the construction of a transparent electrode 35 connected to the same potential as that of the magnet roll assembly 17, FIG. 5*b* shows the construction in which a bias power source 36 is connected between the magnet roll assembly 17 and the transparent electrode 35 in such a polarity that the potential of the transparent electrode 35 is maintained at a certain potential of the same polarity as the charged toner, and FIG. 5*c* shows the construction in which a certain potential difference is applied between the magnet roll assembly 17 and the transparent electrode 35 by applying a developing bias voltage to the magnet roll assembly 17 from a power source 37, and maintaining the transparent electrode 35 at the earth potential.

Figure 6:
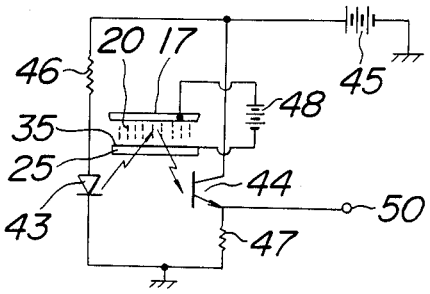
FIG. 6 is a detailed circuit diagram showing one embodiment of an essential part of the toner concentration detecting device according to the present invention.

FIG. 6 shows an embodiment of a circuit arrangement of a toner concentration detecting device according to the present invention, in which a light emitting diode 43 is used as the light source and a phototransistor 44 as the photoelectric transducer element. The light emitting diode 43 is connected to a direct current power source 45 through a current limiting resistance 46, the emitter of the phototransistor 44 is connected to the earth through a load resistance 47, and a collector thereof is connected to the power supply source 45. The transparent electrode 35 on the surface of the transparent plate 25 is connected to the magnet roll assembly 17 through a bias power source 48 so as to maintain the transparent electrode 35 at a certain potential with respect to the magnet roll assembly 17. In such a circuit, the developer 20 is illuminated through the transparent plate 25 and the transparent electrode 35 by the radiation from the light emitting diode 43, and when reflected light enters into the phototransistor 44 through the transparent electrode 35 and the transparent plate 25, photocurrent corresponding to the received light amount flows into the phototransistor 44 through the load resistance 47, and a detecting output voltage in proportion to the photocurrent is obtained from an output terminal 50.

Figure 7:
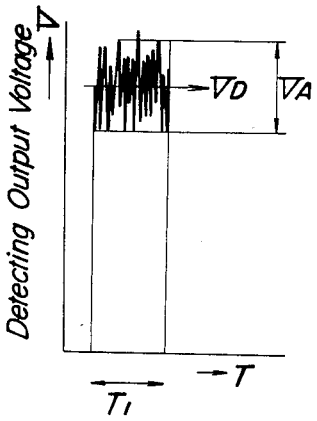
FIG. 7 is a waveform of the sensing output voltage obtained from the circuit shown in FIG. 6.

FIG. 7 is a graph showing the relation between the detecting output voltage V obtained from the output terminal 50 shown in FIG. 6 and time T, and further showing the state of the detecting output when the power supply source 46 is made ON during a period $T_1$ while the magnet roll assembly 17 is actuated.

The detecting output voltage consists of a direct current component $V_D$ corresponding to the average reflectance of the developer 20 and an alternating current component $V_A$ showing an output variation produced in accordance with the movement of the ear-ups. When the magnet roll assembly 17 is not operated, the output voltage is a stable direct current voltage only.

Figure 8:
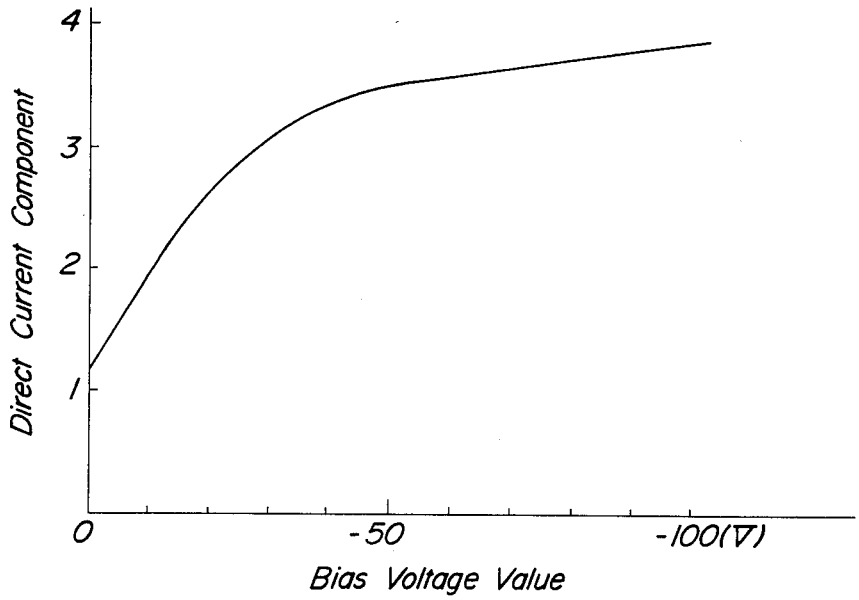
FIG. 8 is a graph showing the relation between a transparent electrode bias voltage value and the direct current component of the photoelectric output in the circuit shown in FIG. 6.

FIG. 8 shows the condition of the variation of the mean value $V_D$ of the direct current component of the photoelectric detecting output when the voltage value of the bias supply source 48 for the transparent electrode 35 is changed in the circuit construction shown in FIG. 6. However, the polarity of the bias voltage applied to the transparent electrode 35 is the same as the polarity of the charged toner, and the developer 20 is made by adding 8.5 parts by weight of toner powers to 100 parts by weight of magnetic powders. In FIG. 8, from 0 V to nearly −50 V of the transparent electrode bias voltage, the output voltage increases depending largely upon the bias voltage, and even if a higher bias voltage is applied, the photoelectric output voltage does not increase substantially. This phenomenon is due to the fact that toner which is not strongly held by magnetic powders adheres to the transparent electrode 35 as fogging toner. If the bias voltage applied to the transparent electrode 35 becomes high, it repels the fogging toner, toner adhesion to the transparent electrode 35 is restricted and the photoelectric output increases but when the bias voltage value is increased to a certain level, the fogging toner hardly adheres and the photoelectric output does not change greatly. Therefore, in order to obtain precisely the toner concentration in the developer, that is, in order to obtain precisely the detecting output corresponding to the reflectance of the developer, it is preferable to apply the bias voltage between the magnet roll assembly 17 and the transparent electrode 35 in such a polarity that the transparent electrode 35 becomes the same as the polarity of the charged toner. According to the invention it is also possible to maintain the transparent electrode 35 at the same or substantially the same potential as that of the magnet roll assembly 17. In such a case, since fogging toner is liable to adhere onto the transparent electrode, it is possible to obtain a photoelectric output which is corrected by the fogging toner. That is, if the fog increases due to the fatigue or the like of the developer, the detecting output representing a concentration higher than the actual toner concentration is obtained, and if the toner concentration is adjusted on the basis of the above detecting output, the toner concentration may be reduced and the fog may also be reduced to keep a balance.

Figure 9:
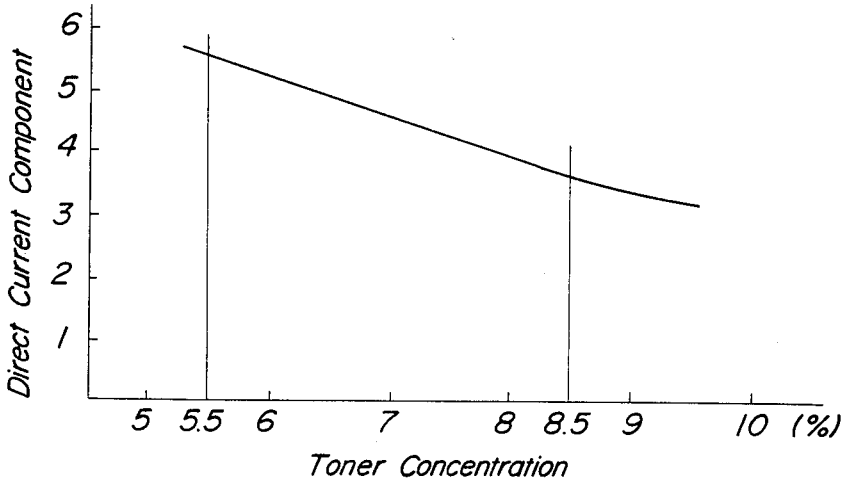
FIG. 9 is a graph showing the relation between a toner concentration and the direct current component of the photoelectric output in the same manner.

FIG. 9 shows the condition of the change of the direct current component of the photoelectric output when a developer having a negatively charged toner is used and the toner concentration in the developer is changed, while a bias voltage of −70 V is applied to the transparent electrode 35. In FIG. 9, in the region from 5.5% to 8.5% of the toner concentration the photoelectric output is also approximately linearly changed relative to the change of the toner concentration. In addition, in the region of more than 8.5% of the toner concentration, the change of the photoelectric output tends to reduce to a slight extent, but substantial change of the photoelectric output is still existent and thus the toner concentration can be detected with a high resolving power.

Figure 10:
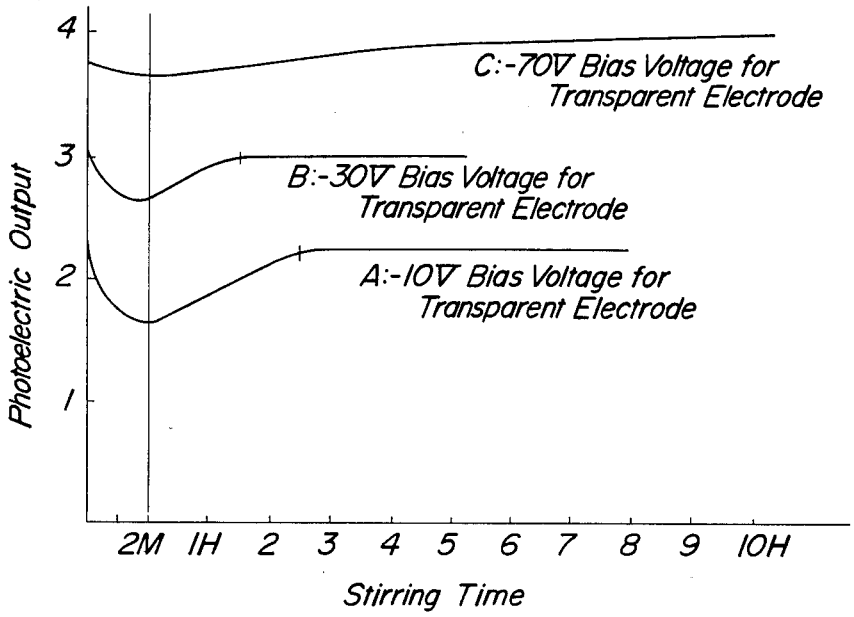
FIG. 10 is a graph showing the relation between developer stirring time and photoelectric output voltage, while the transparent electrode bias voltage value is taken as a parameter.

FIG. 10 shows the change of the photoelectric detecting output with respect to stirring time with bias voltage value applied to the transparent electrode 35 being a parameter. In FIG. 10 the abscissa denotes stirring time and the ordinate represents photoelectric output voltage. On the abscissa the stirring time is denoted by two different scales, i.e., a minute scale for showing rapid change of the photoelectric output in the beginning of stirring and an hour scale for showing succeeding slow change. As the developer, use is made of a negatively charged toner developer prepared by adding 8.5 parts by weight of toner to 100 parts by weight of magnetic powders. Curve A shows the change of the output voltage when a bias voltage of −10 V is applied to the transparent electrode 35, in which about 30% of the output voltage falls during first two minutes. This fall can be eliminated by stirring for about two hours and half. On the other hand, curve B shows the case of applying a bias voltage of −30 V to the transparent electrode 35, in which the drop of the photoelectric output during first two minutes is about 15%, and stirring of about one hour and a half is required too remove this drop. Curve C shows the case of applying the bias voltage of −70 V to the transparent electrode 35, in which the initial drop is only about 3%. Such variation of the output voltage is a repetitive phenomenon if the developer is restirred after being kept at a standstill for about ten hours, and said change causes a reduction in the toner concentration detecting precision. Therefore, it is very effective to apply a bias voltage having the same polarity as that of the charged toner to the transparent electrode 35 in order to remove the influence of such variation. In addition, it is understood that the cause of such a change of the output voltage is that the electrification potential of the toner initially tends to decrease and the fog tends to increase if the stationary developer is stirred, while the image concentration also increases, and the charge amount of toner gradually increases, the fog reduces and the image concentration decreases when stirring is continued. Therefore, the toner concentration detecting signal does not simply correspond to the toner concentration in the developer, but it is possible to obtain a signal which includes the fogging characteristic and image concentration. That is to say, a signal corresponding to a toner concentration higher than the actual toner concentration is obtained when the image concentration increases and the fog tends to increase. For this purpose, it is preferable to apply a lower bias voltage to the transparent electrode 35 or to keep the bias voltage at the same potential as that of the magnet roll assembly 17. In this manner, the dry-type, magnetic, two-component developer 20, in case of use under high humidity conditions, tends to reduce the electrification amount of the toner, to raise the image concentration and further to generate fog, so that the toner concentration detecting signal can be corrected by slightly adhering the toner to the transparent electrode 35. That is, when showing a tendency to lower toner electrification amount and to increase image concentration and fog, a signal corresponding to the toner concentration higher than the actual toner concentration is produced, so that the toner concentration control circuit is balanced at a lower toner concentration level, thereby enabling one to properly keep the image concentration and to suppress the increase of fog. As described above, the toner concentration detecting signal can be corrected by the fogging toner which will be adhered to the transparent electrode 35, but the correction amount thereof can optionally be controlled by changing the bias voltage applied to the transparent electrode 35.

As shown in FIG. 7, the toner concentration detecting signal of this embodiment includes a direct current component $V_D$ and an alternating current component $V_A$. Therefore, the direct use of this signal as a control signal of toner concentration is sometimes disadvantageous because of a variation of the signal level. As the method in which said disadvantage is resolved and the toner concentration detecting signal available for controlling the toner concentration is obtained immediately, use may be made of a direct current component $V_D$ of the detecting signal as shown in FIG. 9. In order to use the direct current component $V_D$ of such photoelectric detecting signal, provision may be made of a filter circuit for removing the alternating current component $V_A$ in the photoelectric detecting output signal, so that a signal corresponding to the direct current component of the photoelectric detecting signal is derived.

Figure 11A:
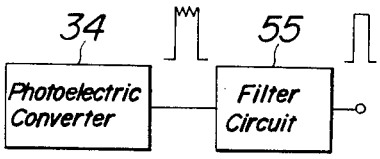
FIGS. 11*a* and 11*b* are block diagrams showing the circuit construction for extracting the direct current component from the photoelectric output and a detailed circuit diagram of one embodiment thereof.
Figure 11B:
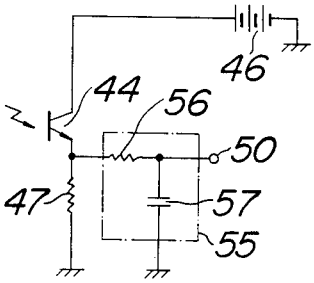

FIG. 11*a* is a block diagram of a construction in which an alternating current component $V_A$ is removed from a detecting output signal obtained from a photoelectric transducer element 34, and a filter circuit 55 is provided for obtaining a direct current output corresponding to a mean value of the output. Such a filter circuit 55 can be constructed to remove an alternating current component $V_A$ by passing an output signal generated in a load resistance 47 connected to an emitter of a phototransistor 44 through a resistance 56 and a capacitor 57 as shown in FIG. 11*b*.

In the above-described embodiment, the direct current component $V_D$ of the photoelectric detecting output is derived, but it is also possible to extract the alternating current component $V_A$ of the photoelectric detecting output signal shown in FIG. 7 and to obtain a toner concentration detecting signal on the basis of the amplitude $V_A$ thereof. This method may be advantageously applied if the photoelectric detecting signal is small and hence the signal should be amplified considerably.

Figure 12:
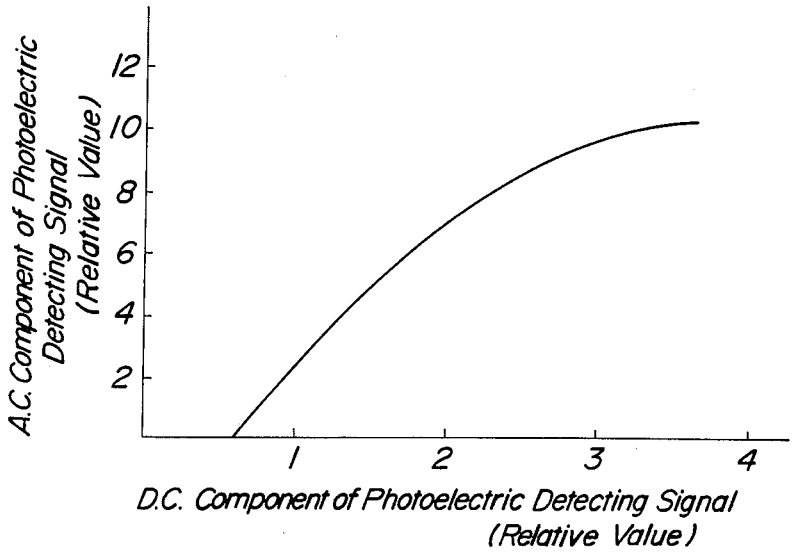
FIG. 12 is a graph showing the relation between the direct current component and an alternating current component of the photoelectric detecting signal.

FIG. 12 compares the relation between the direct current component $V_D$ of the photoelectric detecting signal as the abscissa and the alternating current component $V_A$ of the photoelectric detecting signal as the ordinate. As is apparent from FIG. 12, the larger the output signal, the smaller the increased amount of the alternating current component $V_A$ tends to be, but both are in close correlation to the linear relation, so that it is understood that the toner concentration detecting signal can be obtained on the basis of the direct current component $V_A$ of the photoelectric detecting signal.

Figure 13A:
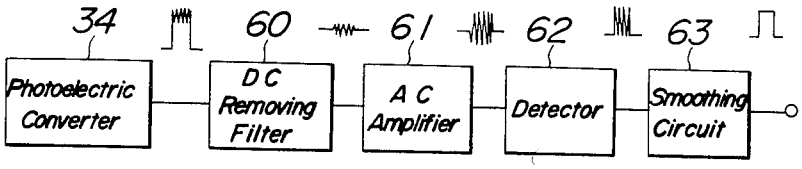
FIGS. 13*a* and 13*b* are block diagrams showing the circuit construction for extracting and treating an alternating current component from the photoelectric output and a detailed circuit diagram of one embodiment thereof.

In order to obtain the toner concentration detecting signal on the basis of the above principle, there may be provided a filter circuit for removing the direct current component $V_D$ in the photoelectric detecting output signal and a circuit for amplifying, detecting and smoothing the alternating current signal, so that a direct current corresponding to the alternating current signal $V_A$ of the photoelectric detecting signal is obtained. FIG. 13*a* shows a block diagram of such a circuit in which a signal containing a direct current component $V_D$ and an alternating current component $V_A$ derived from the photoelectric transducer element 34 is supplied to a direct current component removing filter circuit 60 in which circuit 60 the alternating current component $V_A$ is extracted and the signal thus obtained is converted from a weak signal to a strong signal by an AC amplifier circuit 61. The AC amplifier circuit 61 is an extremely advantageous circuit construction for precisely picking up and amplifying a signal without subjecting it to any influence such as external disturbance, drift or the like mixed in the signal circuit. That is, in order to obtain an alternating current detecting signal in the general photoelectric detecting device, special means for modulating a light source is required, but in the present embodiment, the alternating current component $V_A$ contained in the detecting signal is utilized so that the alternating current amplification technique can be applied extremely easily. The amplified alternating current signal is converted into a pulsating current by a detector circuit 62, and a direct current signal is obtained by a smoothing circuit 63.

Figure 13B:
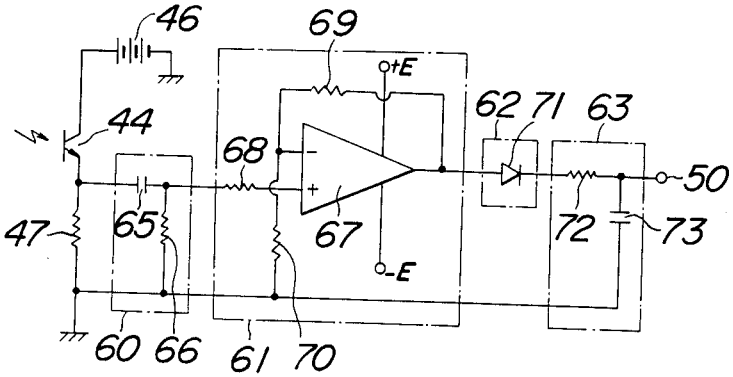

FIG. 13*b* shows an embodiment of the detailed circuit construction shown in FIG. 13*a*. From the photoelectric detecting output produced across the load resistance 47 of the phototransistor 44 the alternating current component is separated by the direct current component removing filter circuit 60 consisting of a capacitor 65 and a resistance 66 and supplies it to the alternating current amplifier circuit 61 composed of an operational amplifier 67. To the operational amplifier 67 are connected power supply sources +E and −E of positive and negative polarities, and the input alternating current signal from filter circuit 60 is applied to the positive polarity input terminal through a resistance 68 to 20 the negative polarity input terminal are connected resistances 69 and 70 for gain control, so that the input alternating current signal is increased. In the embodiment of this alternating current amplifier circuit, two supply sources of positive and negative polarities are used, but it is also possible to construct a circuit with only a positive polarity supply source. The output of the operational amplifier 67 is rectified to a half wave by a diode 71 comprising detector circuit 62 and is converted into a pulsating current of one polarity. The pulsating current signal is converted into a direct current signal by the smoothing circuit 63 consisting of a resistance 72 and a capacitor 73, and is supplied to an output terminal 50.

The toner concentration detecting signal obtained as described above can be used for various purposes. For example, a signal for automatically adjusting concentration of the developer is provided by comparing said detecting signal with a predetermined reference voltage by means of a comparator. Also said detecting signal can serve as the input for two comparators in which respective reference voltages are set, so that an automatic concentration adjusting signal is formed by comparing with one reference voltage and a signal for display of a warning of lack of toner in a toner hopper by comparing with the other reference voltage, or a signal can be provided for inhibiting the action of the developing apparatus. Alternatively, a toner concentration measurement display device can be provided in such a manner that a toner concentration detecting signal voltage value is displayed. In addition, it is also possible to read the variation of the photoelectric detecting output signal obtained by changing a bias voltage applied to a transparent electrode the measurement of toner concentration, and to obtain a signal showing the condition of fog of the developer from a change of the output signal.

As explained in detail, according to the invention, it it possible to realize a toner concentration detecting device of extremely simple and small construction, having high discriminating resolution of toner concentration, being largely unaffected by any influence such as a change of environmental conditions, the stirring condition of the developer per se, deterioration of endurance, and the like, without the generation of detectable error due to contamination of the detecting element.

What is claimed is:

1. A device for detecting toner concentration of a dry-type, two-component, magnetic developer consisting of magnetic carrier powders and toner powders contained in a housing of a developing apparatus having magnetic roll means including a plurality of magnetic poles of successively different polarities to form a plurality of independent ear-ups of the developer which correspond to the magnetic poles and are brought in contact with a member to be developed, said device comprising:

transparent plate-like means arranged to be brought in contact with the ear-ups of the developer which are held and carried by said magnetic roll means and have a lower developer concentration as compared with other portions of the developer than the ear-ups, wherein the surface of the transparent plate-like means is cleaned by the contact thereof with the ear-ups of the developer;

means for projecting light toward the ear-ups of the developer through the transparent plate-like means;

means for receiving light reflected by the ear-ups of the developer through the transparent plate-like means to produce a photoelectrically converted signal representing the toner concentration of the developer; and means for optically separating from each other an optical path from the light projecting means to the transparent plate-like means and an optical path from the transparent plate-like means to the light receiving means.

2. A toner concentration detecting device as set forth in claim 1, wherein said transparent plate-like means, light projecting means, light receiving means and optically separating means are formed as an integral detecting unit and the detecting unit is arranged in said housing.

3. A toner concentration detecting device as set forth in claim 2, wherein said detecting unit is sealed in an airtight manner.

4. A toner concentration detecting device as set forth in claim 1, wherein said light projecting means, light receiving means and optically separating means are formed as an integral unit and the unit is arranged outside said housing in such a manner that the transparent plate-like means is in contact with the ear-ups of the developer.

5. A toner concentration detecting device as set forth in claim 4, wherein an opening is formed in said housing and said transparent plate-like means is arranged at said opening so as to contact with the ear-ups of the developer.

6. A toner concentration detecting device as set forth in claim 1, wherein said light projecting means comprises a GaAs infrared radiation emitting diode.

7. A toner concentration detecting device as set forth in claim 1, wherein said light receiving means comprises a Si phototransistor.

8. A toner concentration detecting device as set forth in claim 1, wherein said transparent plate-like means is so arranged with respect to said magnet roll means that the light of the ear-ups is regulated by said transparent plate-like means, and toner powders adhered onto the transparent plate-like means are at least partially removed by the cleaning action of the ear-ups of the developer.

9. A toner concentration detection device as set forth in claim 1, wherein the transparent plate-like means is made of material such as glass and mica whose position on the triboelectric series is more positive that the positive charge of the toner material.

10. A toner concentration detecting device as set forth in claim 1, wherein the transparent plate-like means is made of material such as cellulose nitrate and hard vinyl chloride whose position on the triboelectric series is more negative than the negative charge of the toner material.

11. A toner concentration detecting device as set forth in claim 1, wherein said transparent plate-like means comprises a transparent electrode and the device further comprises means for applying a given potential to the transparent electrode.

12. A toner concentration detecting device as set forth in claim 11, wherein said transparent electrode is connected to the same potential as that of said magnet roll means.

13. A toner concentration detecting device as set forth in claim 11, wherein the potential applying means comprises a bias power source connected between the magnet roll means and the transparent electrode, and the potential of the transparent electrode is maintained at a certain potential of the same polarity as that of the charged toner.

14. A toner concentration detecting device as set forth in claim 11, wherein a developing bias voltage is supplied to the magnet roll means and said potential applying means comprises means for connecting the transparent electrode to the earth.

15. A toner concentration detecting device as set forth in any one of claims 11 to 14, wherein said transparent electrode consists of an electrically insulating transparent plate and an electroconductive transparent layer coated on that surface of said plate which faces the ear-ups of the developer.

16. A toner concentration detecting device as set forth in claim 1, wherein said device further comprises a filter circuit for removing an alternating current component from the photoelectrically converted signal, and a circuit for deriving a signal corresponding to the toner concentration from a direct current component supplied from the filter circuit.

17. A toner concentration detecting device as set forth in claim 1, wherein the device further comprises a filter circuit for removing a direct current component from the photoelectrically converted signal, and a circuit for generating a direct signal corresponding to the toner concentration from an alternating component supplied from the filter circuit.

18. Apparatus for detecting toner concentration of a dry-type, two-component, magnetic developer consisting of magnetic carrier powders and toner powders contained in a housing of a developing apparatus, said apparatus comprising:

magnetic roll means including a plurality of magnetic poles of successively different polarities to form a plurality of independent ear-ups of the developer which correspond to the magnetic poles and are brought in contact with a member to be developed;

transparent plate-like means arranged to be brought in contact with the ear-ups of the developer which are held and carried by said magnetic roll means and have a lower developer concentration as compared with other portions of the developer than the ear-ups, wherein the surface of the transparent plate-like means is cleaned by the contact thereof with the ear-ups of the developer;

means for projecting light toward the ear-ups of the developer through the transparent plate-like means;

means for receiving light reflected by the ear-ups of the developer through the transparent plate-like means to produce a photoelectrically converted signal representing the toner concentration of the developer; and means for optically separating from each other an optical path from the light projecting means to the transparent plate-like means and an optical path from the transparent plate-like means to the light receiving means.

* * * * *